United States Patent [19]

Martin et al.

[11] Patent Number: 4,753,712

[45] Date of Patent: Jun. 28, 1988

[54] PAPERMACHINE FELT SHOWER OSCILLATOR

[75] Inventors: Alton R. Martin, Hanahan; Clifford D. Shelor, Charleston, both of S.C.

[73] Assignee: Westvaco Corporation, New York, N.Y.

[21] Appl. No.: 58,840

[22] Filed: Jun. 5, 1987

[51] Int. Cl.[4] ..... D21F 1/32; B08B 3/02

[52] U.S. Cl. ..... 162/199; 68/205 R; 134/122 R; 162/277

[58] Field of Search ..... 162/199, 277, 274, 275, 162/276; 134/122 R; 239/752; 277/3; 68/20, 205 R

[56] References Cited

U.S. PATENT DOCUMENTS

| | | | |
|---|---|---|---|
| 1,459,161 | 5/1923 | Roberts | 162/277 |
| 1,859,508 | 5/1932 | Harris | 162/277 |
| 3,135,653 | 6/1964 | Smith | 162/277 |
| 3,739,605 | 6/1973 | Baker | 68/20 |
| 3,910,815 | 10/1975 | Shelor | 162/199 |
| 4,087,097 | 5/1978 | Bossens et al. | 277/3 |
| 4,167,440 | 9/1979 | Falk | 162/277 |
| 4,358,119 | 11/1982 | Kryczun | 277/3 |

FOREIGN PATENT DOCUMENTS 665506 6/1963 Canada .

*Primary Examiner*—David L. Lacey
*Assistant Examiner*—K. M. Hastings
*Attorney, Agent, or Firm*—W. A. Marcontell; R. L. Schmalz

[57] ABSTRACT

Papermachine felts and wires are cleaned and maintained by pressurized fluid jets or showers which are oscillated transversely across the felt running direction over a fixed oscillation stroke distance. Superimposed on the fixed stroke distance is a periodic shift of the stroke reference point so that successive oscillations are not terminated at the same point. The oscillation drive mechanism is enclosed within a low pressure, gas-tight housing serviced by a pressure regulated gas supply. A reversible A-C motor is used to drive the mechanism.

13 Claims, 3 Drawing Sheets

PAPERMACHINE FELT SHOWER OSCILLATOR

BACKGROUND OF THE INVENTION

1. Field of the Invention

The present invention relates to the art of papermaking.

More specifically, the present invention relates to the maintenance of paper web carrying screens and felts in a clean and operatively efficient condition.

2. Description of the Prior Art

In the papermaking process, an aqueous slurry of cellulose is laid upon the traveling, table surface of an endless belt of screen material. In transit, from one end of the table surface to the other, a major portion of the water vehicle is drawn through the screen cell spaces to leave a loosely matted web of wet cellulose.

At the dry end of the traveling table, the web mat is transferred to a tightly woven fabric belt characterized as a press felt. One function of the press felt is to provide substrate support for the web as it is threaded through a plurality of roll press nips. Another function of the press felt is as an intimate contact moisture wick to draw additional water from the web.

In the course of continuous operation, the press felt will accumulate minute particles of cellulose fiber to fill, coat or otherwise obstruct the porous quality of the felt. Such coatings and fillings greatly inhibit the wicking function of the felt and streak the web carried thereon.

The conventional technique for cleaning a press felt without removal from service is to intermittently or continuously direct a multiplicity of high pressure jet streams of water against the felt surface. Typically, such jet streams are spaced across the felt width on six or twelve inch centers and reciprocated in the cross direction with an approximately twelve inch stroke. U.S. Pat. Nos. 1,381,272 and 3,135,653 provide representative descriptions of suitable equipment.

Theoretically, each jet stream will clean a narrow band area about the felt circumference. If the traverse rate is coordinated with the felt speed, the entire felt is cleaned over a period of time by a continuous, closely wound helical trace of each jet stream around the felt perimeter.

Multiple jet streams issuing from respective nozzles in a pipe spanning the felt width reduce the oscillation period of the pipe and hence, the cleaning cycle. The helical trace of each jet continues from the stroke start to termination. The terminating point of one jet is the starting point for the next adjacent jet.

There are numerous permutations of this general cleaning scheme but the usual practice is to space the jet nozzles along the conduit length by a distance equal to the oscillation stroke length. An adverse consequence of this scheme is that the bands of shower impact against the felt corresponding to the stroke terminus are flushed twice in a cleaning cycle. Since the felt is minutely damaged by each cycle, these bands of impact coincidence result in areas that are damaged at twice the rate of the remaining felt surface. In time, the damage difference increases sufficiently to mark the paper product with corresponding bands.

Another difficulty with short stroke oscillating showers is that of protecting the oscillation mechanism from a humid, papermachine atmosphere. Although the mechanism may be enclosed by a watertight housing, water eventually invades the interior to foul the machinery. Water invasion is often a result of pressure differentials occurring as a consequence of the stroking mechanism volume which oscillates in and out of the sealed housing chamber. This heretofore unavoidable result has occasioned restricted and expensive mechanical designs using direct current drive motors.

It is therefore, an object of the present invention to provide a felt shower oscillating mechanism which superimposes a movement in the oscillation stroke reference point upon the fixed stroke distance to spread the stroke terminus band over a greater area.

Another object of the invention is to provide a housing for the oscillation mechanism that is served by a regulated low pressure gas supply to exclude environmental air.

Another object of the present invention is to teach the design parameters of a papermachine felt shower oscillating mechanism that may be driven by a low rotor mass, reversible AC motor.

SUMMARY

These and other objects of the invention are accomplished by a felt shower oscillation mechanism that is encased within a gas tight housing served by a regulated supply of dry, low pressure gas such as instrument service air.

Traverse drive of the oscillating mechanism is served by a lead screw and nut. Reversal is accomplished by polarity switching the power to a low mass rotor, alternating current motor that belt drives the worm hub with a high ratio of reduction.

With each stroke cycle of the traverse drive, the stroke reference point within the mechanism is shifted by a distance approximately equal to the jet impact band width. These reference point shifts are continued in one direction over about a 0.5 inch shift span. When the end of the shift span is reached, the shifting mechanism retracts the reference point to the starting position at an accelerated rate.

BRIEF DESCRIPTION OF THE DRAWINGS

Relative to the several figures of the drawings wherein like reference characters designate like or similar elements.

DESCRIPTION OF THE PREFERRED EMBODIMENT

Figure 1:
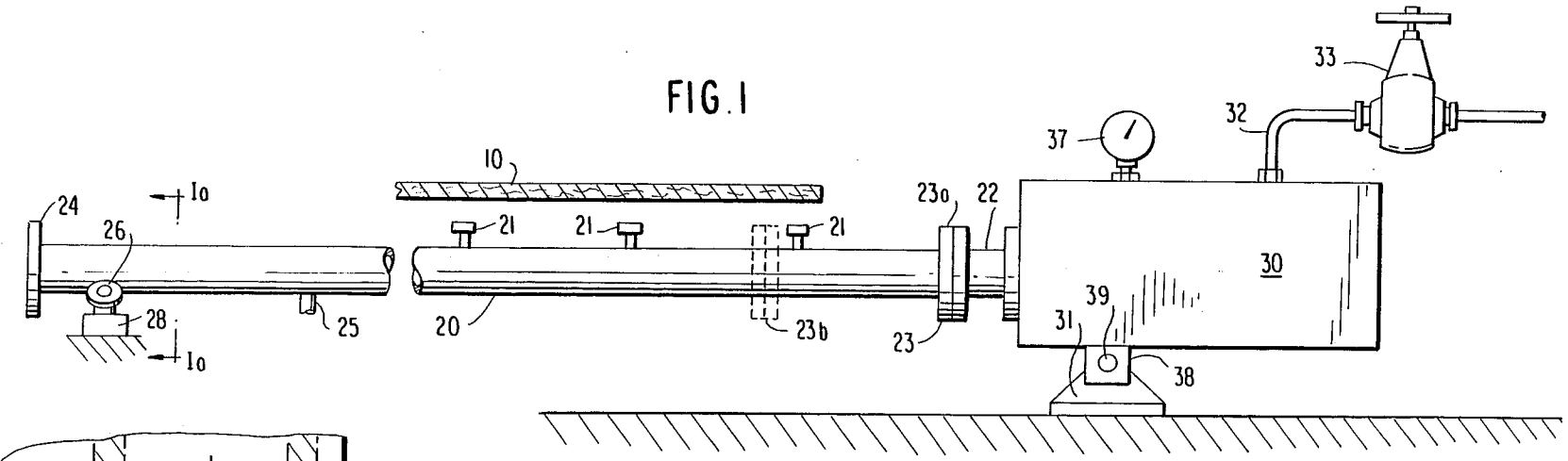
FIG. 1 is an elevational view of the present invention.
Figure 9:
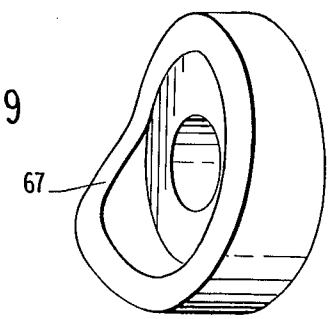
FIG. 9 is a pictorial view of the present invention end shifting cam.
Figure 1A:
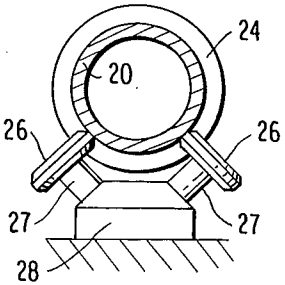
FIG. 1*a* is an end elevation section of the oscillating manifold element of the invention.

The present invention operating environment is represented by FIG. 1 which shows a papermachine felt 10 along a longitudinal, in-plane, partial section. Although this description is addressed to paper machine felts, it applies more comprehensively to papermachine clothing which includes both screens and felts.

Transversely spanning the felt width is a cleaning shower manifold 20 that is closed at both ends by blind flanges 23 and 24. The distal end of the manifold is supported by a pair of wheels 26 rotating on spindles 27 secured to a foundation base 28.

The driven end of the manifold 20 is flange connected to an oscillation piston 22 which is reciprocated by an oscillation mechanism in and out of an hermetically sealed housing 30. A single support bracket 38 carries the housing 30 with pivotal freedom about an axle 39. The axle is mounted on a foundation pad 31.

Between the flanges 23 and 24 of manifold 20 are a plurality of equally spaced hydraulic jet or spray nozzles 21 directed for discharge against the web 10. Water or other cleaning fluid is supplied to the manifold 20 through an external coupling connection 25.

In addition to electrical power not shown, the housing 30 internal volume is supplied with dry, low pressure gas through conduit 32 at a substantially constant low pressure controlled by regulator 33. An internal pressure gauge 37 continuously reports the housing pressure. Instrument supply air is the normal source of housing gas but particular environments or circumstances may suggest the use of nitrogen or other special gases.

Although every reasonable effort may be made to seal the housing 30 hermetically, the oscillating volume represented by the piston 22 will eventually induce the hot, humid, ambient papermachine air into a housing without the internal pressure system taught hereby. In the case of an unpressured housing, as the piston 22 is out-stroked from the housing interior, the internal volume reduction represented by the piston mass creates a partial vacuum within the housing. Hence, ambient wet air is induced to enter the housing under the sliding seal around the piston where it passes through the housing wall. When the piston in-strokes, the opposite occurs to raise the internal housing pressure and cause some housing gas to escape past the piston seal. Loss of such internal gas may amplify the partial vacuum condition previously described.

By placing the oscillation mechanism housing under a low, regulated, positive pressure head of dry gas, vacuum conditions never arise inside the housing 30 to induce an influx of wet, ambient air. Consequently, an inexpensive, low rotor mass, alternating current drive motor may be safely and reliably used inside the housing without concern for corrosion or shorting.

Figure 2:
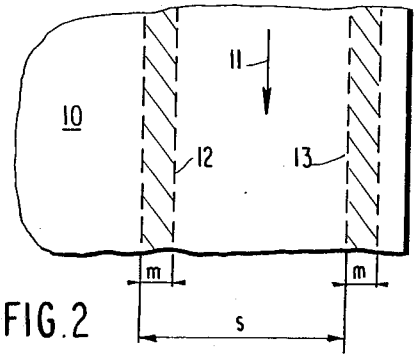
FIG. 2 is a partial plan of a papermachine felt subject to the present invention operation.

For understanding of the present oscillation mechanism operation, reference is first given to FIG. 2 which shows a section of felt 10 with a machine running direction arrow 11 applied. Parallel with the machine direction are longitudinal cross-hatched areas 12 and 13. One of these areas 12, etc. may be shown across the entire felt width for each manifold nozzle 21. The full, oscillatory stroke of piston 22 is represented by the dimension s between the left-hand edges of adjacent areas 12 and 13. The width of each area 12 and 13 however, is dimension m.

In translation, the areas 12 and 13 represent the regions of oscillation termination respective to a single nozzle 21. When the piston 22 is at the full out-stroke position, spray or jet from the respective nozzle 21 strikes the felt 10 within the cross-hatched area 12. When the piston 22 is at the full in-stroke position, spray from the same nozzle 21 strikes the felt 10 within the area 13. Area width m delineates the region that the spray lines of stroke termination will fluctuate over a long period of oscillatory operation.

As an example, assume a nozzle 21 jet width of 0.033 inch wide spaced at 6 inches apart along the manifold 20 length and a 12 inch piston 22 stroke distance, s. The piston 22 stroking velocity, in and out, is 1 inch per minute. At a surface velocity of 1500 feet per minute, the felt 10 will cycle 30 times per minute. At this rate, the felt 10 will complete 360 full circuits around its respective machine course while the jet of one nozzle 21 travels from the left edge of area 12 to the left edge of area 13. However, in the course of 16 piston oscillation cycles ($2\times16\times360=11{,}520$ full felt circuits), the stroke terminating lines from nozzle jet impact with the felt 10 will shift from the left-hand edges of areas 12 and 13 to the right-hand edges. This shift represents a secondary oscillation having an amplitude m equal to 0.480 inches.

In summary then, 720 felt revolutions occur for each piston 22 cycle while 11,520 felt revolutions occur for each cycle of shift in the stroke limit line. Assuming a machine running speed of 30 felt cycles per minute, 24 minutes are required to accomplish a full cycle of the piston 22 displacement whereas 6 hours and 24 minutes are required for a full cycle of terminus line shift over 0.480 inches.

The mechanism to accomplish the aforedescribed compounded oscillation is disposed within the protective enclosure of housing 30. FIGS. 3 through 6 illustrate that disposition.

Internally of the housing 30, a static bearing wall 34 spans the enclosure transversely. Secured between the bearing wall 34 and the front housing wall 35, is a lower guide/alignment rod. An upper guide/alignment rod 41 is secured between the front housing wall 35 and the rear housing wall 36. These guide/alignment rods pass through a traveling block 42. Liner bearings or bushings 43 and 44 line the rod penetration apertures of traveling block 42 to reduce sliding friction and misalignment with the guide rods 40 and 41.

Also penetrating the bearing wall 34 and the traveling block 42 is a lead screw 50. Anti-friction bearings support the lead screw shaft 51 where it penetrates the bearing wall 34. A threaded drive nut is secured in the traveling block 42 for transfer of drive force from the lead screw 50 to the block 42.

Rotatively driving the screw 50 is a belt sheave 52 that is key-set onto the screw shaft 51. A low rotor mass, reversible, alternating current electric motor 53 drives a primary sheave 55 through a geared reduction unit 54. A flexible drive belt 56 transfers rotary power from the primary sheave 55 to the screw shaft sheave 52.

Structurally, piston 22 is a circular section hollow tube having the inner end thereof rigidly secured to the traveling block 42 concentrically about the screw 50 axis. Although the screw 50 rotates about its longitudinal axis, the screw is stationary in directions longitudinally parallel with the screw axis. Rotation of the screw drives the traveling block 42, and hence, the piston 22, toward or away from the bearing wall 34, depending on the direction of rotation.

As the piston 22 reciprocates along the screw 50 length, each one-way stroke incrementally functions the mechanism responsible for shifting the stroke reference point. Within the traveling block 42, a rotatable and axially shiftable axle shaft 60 is mounted through oppositely bushed apertures 61. A linear cam following paddle 62 is non-rotatively secured to the shaft 60 with an axle key 63. Also key mounted to the shaft 60 is a one-way clutch 64 having an inner race 65 and an outer race 66. The outer race 66 is rigidly secured to a cylinder cam 67. A shaft collar 68 secures the axial position of the cam 67 along the shaft 60 length between the collar and the follower paddle 62.

Figure 7:
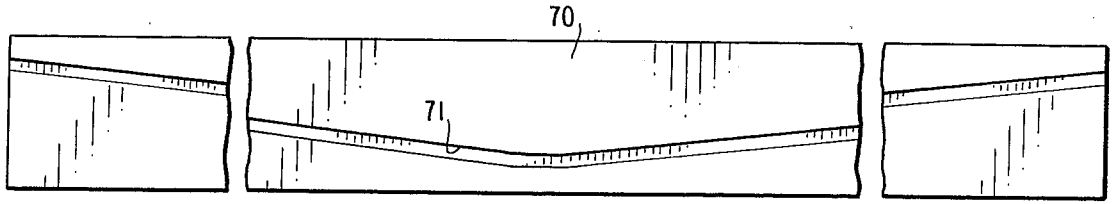
FIG. 7 is an elevation view of the bar cam component of the present invention.

The blade on the follower paddle 62 is guided within the V-profiled slot 71 of a stationary bar cam 70 as shown by FIG. 7. As the traveling block 42 reciprocates along the guide bar, the V-shaped slot 71 profile causes the paddle 62 to oscillate about the shaft 60 axis. At each end of bar cam 70 is a proximity limit switch 72 and 73. When the paddle 62 enters a respective limit switch slot, power polarity to the motor 53 is switched to reverse the motor drive direction.

The profiled face of cylinder cam 67 is firmly clamped between a positionally fixed rolling cam follower 75 and a spring biased plunger 76. Consequently, the line of contact 77 between the rolling cam follower 75 and the profiled surface of cylinder cam 67 is the fixed reference point for the shift mechanism movement. Being a point on the traveling block 42 however, the reference point 75 oscillates relative to the stationary housing 30 but over a fixed oscillation stroke.

As the paddle 62 translates through the cam slot 71, the axle shaft 60 is rotated first in one direction and then the other. When the shaft 60 rotates in the first direction, the one-way clutch 65 slips and transmits insufficient torque to the cylinder cam 67 for rotation against the brake resistance of plunger 76. When the shaft 60 is rotated by the paddle 62 in the other direction, however, one-way clutch 64 seizes to angularly advance the cam 64 about the shaft 60 axis. Simultaneously, the axial position of shaft 60 is changed by the ramp increment on the respective portion of the cam face. This axial shift will correspondingly change the longitudinal position of the paddle 62 relative to the traveling block 42. The distance between limit switches 72 and 73, however, dictates the piston 22 and traveling block 42 stroke length. This does not change: only the longitudinal positionment of the paddle 62 on the traveling block 42 is changed. Hence, the traveling block 42 stroke length s remains constant as determined by the distance between limit switches 72 and 73 but the exact longitudinal position of the traveling block 42 relative to the housing 30 when a reversing switch 72 or 73 is activated is determined by the angular position of cylinder cam 67.

Figure 10:
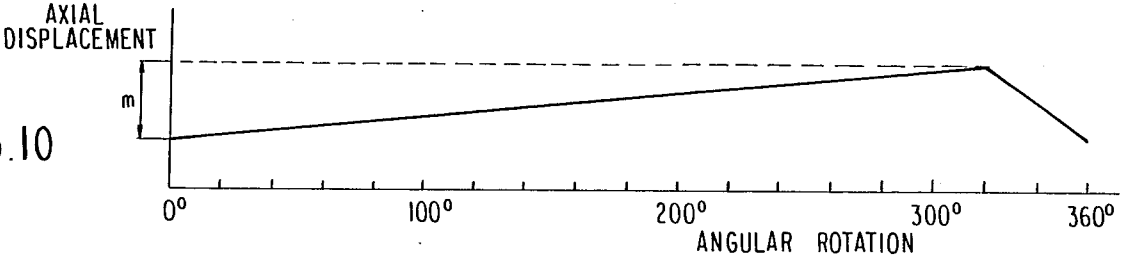
FIG. 10 is a graph of the end shifting cam surface profile.
Figure 4:
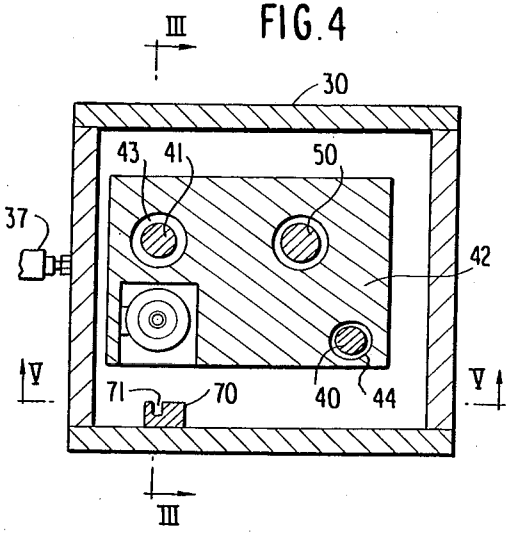
FIG. 4 is an end elevation section of the present invention viewed along cut lines IV—IV.
Figure 6:
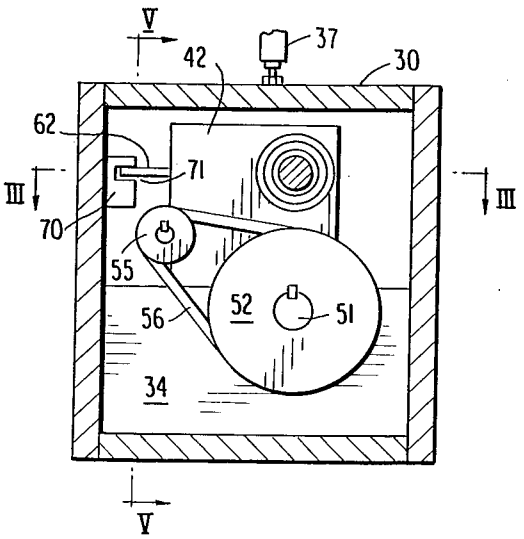
FIG. 6 is an end elevation section of the present invention viewed along cut lines VI—VI.
Figure 3:
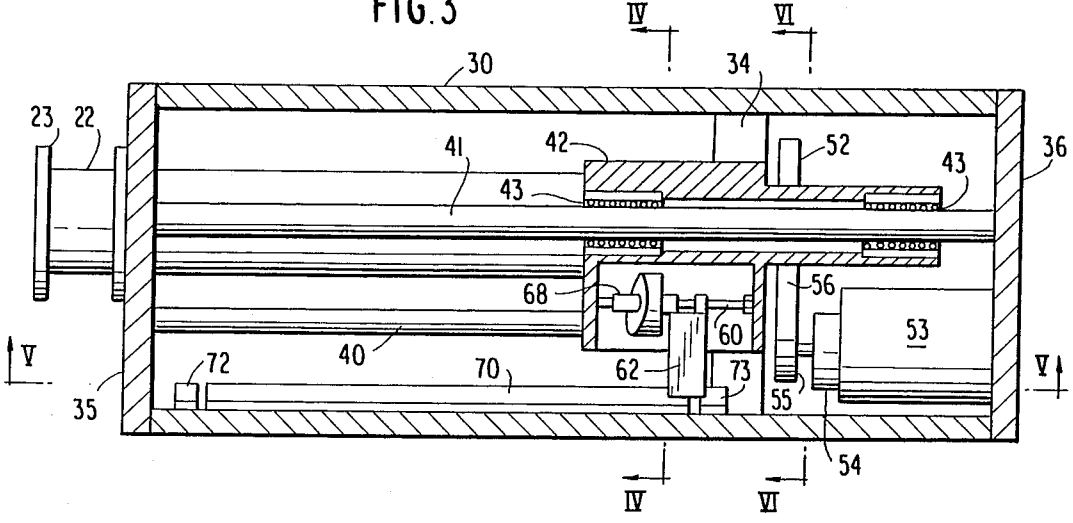
FIG. 3 is a top plan section of the present invention viewed along cut lines III—III.
Figure 5:
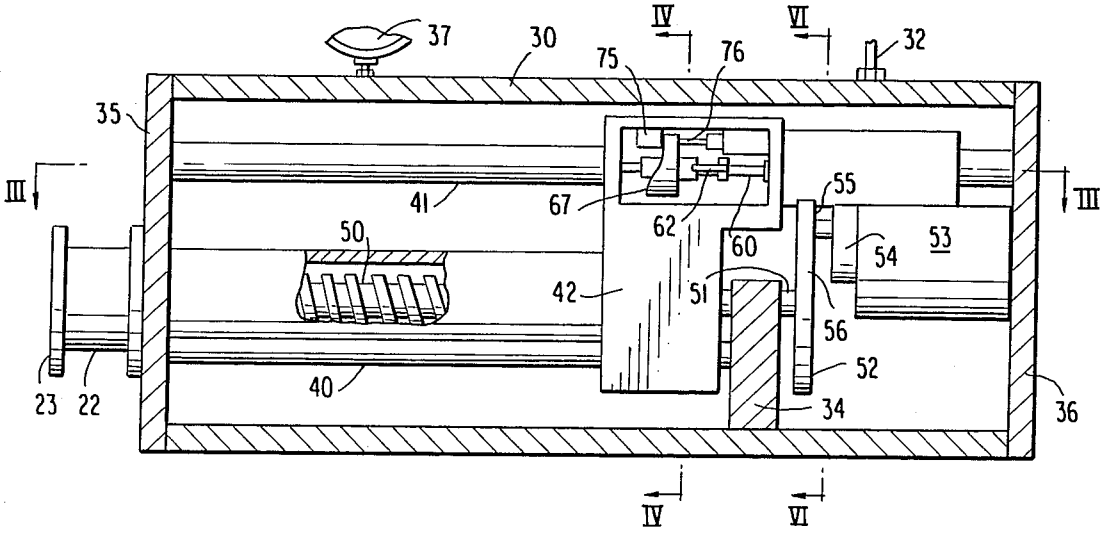
FIG. 5 is a side elevation section of the present invention viewed along cut lines V—V.
Figure 8:
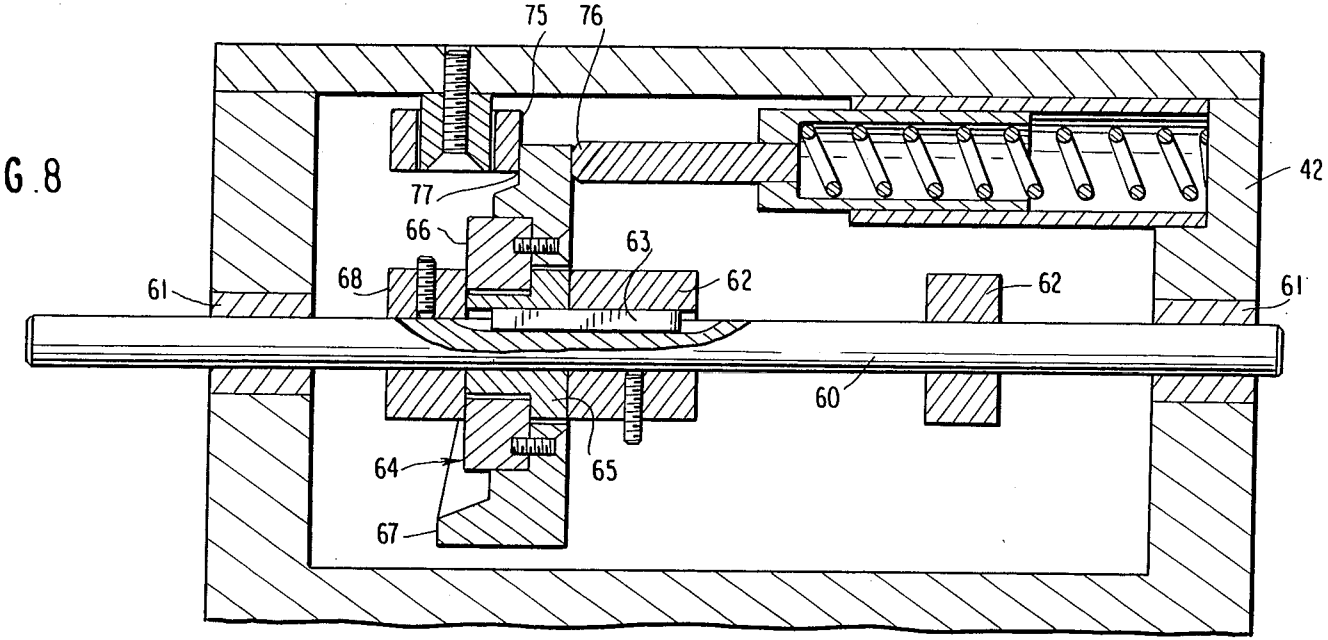
FIG. 8 is a partial section of the present invention end shifting mechanism.

The full amplitude m of this secondary oscillation is determined by the rise of the cam 67 face as shown by FIG. 10. In the foregoing dimensional example, the secondary oscillation amplitude m was 0.480 inch. Also to be noted from FIG. 10 is that the positive ramp of the cam face between the 0° and 320° circular arc positions. A negative ramp links the 320° and 360° cam circle positions. Consequently, the negative slope is 8 times greater than the positive slope. This slope difference is used to immediately advance the cam 67 rotatively to the 0° circle position after passing the face crest at 320°. Hence, 32 piston oscillation periods are required to reach the cam crest at 320° but return to the base position at 0° is immediate: the remaining 40° being autorotated by the steep negative slope cam face in co-operation with the one-way clutch 65.

Having fully described our invention and the operational objectives served thereby, those of ordinary skill in the art may perceive alternative and equivalent submechanisms to accomplish the same ends. As our invention, however,

We claim:

1. A fluid shower oscillation apparatus for maintaining the condition of papermachine clothing by oscillating at least one clothing shower nozzle along a line transverse to a clothing running direction, said apparatus comprising an oscillating mechanism substantially enclosed within a sealed housing and including piston means projecting from said housing through an aperture therein, said piston means being secured to traveling block means within said housing, guide means within said housing to confine movement of said traveling block means to a single line of reciprocation transverse to said clothing running direction, single drive means to cyclically move said traveling block along said reciprocation line by a variable stroking distance which includes a fixed stroke segment and drive control means for only said single drive means to regulate the direction of traveling block movement and points of movement reversal, said drive control means further comprising first means to control the length of said fixed stroke segment and second means to cyclically change the position of said fixed stroke segment by increments relative to said housing whereby said fixed stroke segment position change progresses in increments coordinated to each traveling block reciprocation cycle.

2. An apparatus as described by claim 1 wherein said drive control first means includes moving reference structure secured to said traveling block means and stationary reference structure secured to said housing whereby positional alignment between said moving reference and said stationary reference at either distal end of said fixed stroke segment reverses the drive direction of said single drive means.

3. An apparatus as described by claim 2 wherein said drive control second means comprises means for changing the position of said moving reference structure along said traveling block means by a predetermined increment for each stroke traversal of said traveling block.

4. An apparatus as described by claim 3 wherein said moving reference structure comprises paddle means secured at one end to said traveling block means for pivotal movement about an axis and having a projected distal end confined within a linear cam slot secured to said housing.

5. An apparatus as described by claim 4 wherein said moving reference structure comprises a circular cam element mounted for rotation about said axis, said paddle means and circular cam element being linked by one-way clutch means whereby rotation of said paddle means about said axis in only one rotary direction effects incremental rotation of said circular cam element.

6. An apparatus as described by claim 5 wherein said paddle means and said circular cam element are secured to a common axle means, said paddle means being secured both axially and rotatively to said axle means which has limited axial displacement freedom within support journals, said circular cam element being secured to a rotational element of said one-way clutch which has a fixed element thereof secured both axially and rotatively to said axle means.

7. An apparatus as described by claim 1 comprising a pressurized source of dry gas and conduit means therefor connected to said housing for providing a gas flow channel from said pressurized source into the interior of said housing and thereby maintaining a pressure within said housing greater than the ambient pressure outside of said housing.

8. An apparatus as described by claim 7 wherein said single drive means comprises a lead screw rotated in a nut secured to said traveling block, said lead screw rotation being driven by reversible electric motor means.

9. An apparatus as described by claim 6 wherein said single drive means comprises a lead screw rotated against said traveling block by reversible electric motor means and said stationary reference structure includes limit switches actuated by said paddle means projected distal end to reverse the power polarity of said electric motor means.

10. A method of maintaining the condition of papermachine clothing with the impact of at least one fluid shower stream having an impact width against at least one surface side of said clothing, said method comprising the steps of:

(a) oscillating said fluid shower stream over a stroke distance along a line transverse to a papermachine clothing running direction;

(b) changing the location of said stroke distance along said transverse line by an increment corresponding to the impact width of said shower stream for each stroke traversal; and (c) wherein shower oscillation structure having a single drive means is used for both steps (a) and (b).

11. A method of maintaining the condition of papermachine clothing as described by claim 10 wherein said stroke distance location is returned to a starting location upon the successive completion of a predetermined number of said increments.

12. A method as described by claim 10 wherein said stroke distance is determined by the spacing between two fixed position sensors that are responsive to an indicator positioned on said shower oscillation structure, said stroke distance location change increment being determined by incremental movement of said indicator.

13. A method as described by claim 12 wherein said indicator movement is motivated by movement of said shower oscillation structure.

* * * * *